US010758003B2

(12) United States Patent
Iuchi et al.

(10) Patent No.: US 10,758,003 B2
(45) Date of Patent: Sep. 1, 2020

(54) SOLE STRUCTURE FOR SHOES AND SHOE WITH THE SOLE STRUCTURE

(71) Applicant: Mizuno Corporation, Osaka (JP)

(72) Inventors: Kazunori Iuchi, Osaka (JP); Yusuke Ide, Osaka (JP)

(73) Assignee: Mizuno Corporation, Osaka (JP)

( * ) Notice: Subject to any disclaimer, the term of this patent is extended or adjusted under 35 U.S.C. 154(b) by 181 days.

(21) Appl. No.: 15/922,313

(22) Filed: Mar. 15, 2018

(65) Prior Publication Data

US 2018/0263335 A1 Sep. 20, 2018

(30) Foreign Application Priority Data

Mar. 16, 2017 (JP) ..... 2017-051636

(51) Int. Cl.
*A43B 13/18* (2006.01)
*A43B 13/14* (2006.01)

(52) U.S. Cl.
CPC ..... *A43B 13/186* (2013.01); *A43B 13/141* (2013.01)

(58) Field of Classification Search
CPC .... A43B 13/186; A43B 13/141; A43B 13/206
USPC ..... 36/28, 29, 30 R
See application file for complete search history.

(56) References Cited

U.S. PATENT DOCUMENTS 5,528,842 A * 6/1996 Ricci ..... A43B 13/12 36/103
6,219,940 B1 * 4/2001 Kita ..... A43B 13/026 36/103
6,311,414 B1 11/2001 Kita
7,946,060 B2 * 5/2011 Rosenbaum ..... A43B 13/141 36/28
2003/0000109 A1 * 1/2003 Kita ..... A43B 13/12 36/30 R

FOREIGN PATENT DOCUMENTS

JP 20004905 A 1/2000
JP 2013017604 A 1/2013
WO 2008144446 A1 11/2018

OTHER PUBLICATIONS

Office Action issued in corresponding Japanese Patent Application No. JP2017-051636 dated Apr. 23, 2019 (English machine translation).
Office Action issued in corresponding Japanese Patent Application No. JP2017-051636 dated Apr. 23, 2019 (Japanese language).

* cited by examiner

*Primary Examiner* — Timothy K Trieu
(74) *Attorney, Agent, or Firm* — Troutman Pepper Hamilton Sanders LLP; James E. Schutz; Micah B. Hensley

(57) ABSTRACT

A support of a sole structure includes a base disposed in a middle region in a foot width direction and having an upper surface which follows a plantar surface of a wearer's foot, and upper and lower supports continuous with a side portion of the base on a medial side in the foot width direction. The upper support has an upper surface that is continuous with the side portion of the base such that the upper surface of the upper support, together with the upper surface of the base, follows the plantar surface. The lower support is continuous with the side portion of the base so as to be located under the upper support, and has a corrugated shape having peaks and valleys alternating with each other in a longitudinal direction along the side portion of the base.

14 Claims, 6 Drawing Sheets

SOLE STRUCTURE FOR SHOES AND SHOE WITH THE SOLE STRUCTURE

CROSS-REFERENCE TO RELATED APPLICATION

This application claims priority to Japanese Patent Application No. 2017-051636 filed on Mar. 16, 2017, the entire disclosure of which is incorporated by reference herein.

BACKGROUND

The present disclosure relates to a sole structure for shoes and a shoe including such a sole structure.

A sole structure for sport shoes focusing on cushioning properties has been generally widely known, which includes, as major components, a midsole made of a soft elastic material and an outsole bonded to the lower surface of the midsole. As an improvement of said sole structure, a sole structure for sport shoes, such as one disclosed in Japanese Patent Publication No. 2000-4905, has been suggested to prevent lateral swaying caused by excessive deformation of the shoes in the foot width direction at the time of contact of the shoes on the ground during walking or running.

Japanese Patent Publication No. 2000-4905 discloses a sole structure including: an outsole having a ground surface on its bottom surface, a midsole made of an elastic material layered on an upper side of the outsole; and a corrugated sheet made of a thin layer harder than the midsole and provided in a middle portion, in the thickness direction, of the midsole at a position corresponding to a region from the hindfoot to the midfoot of the wearer's foot. The corrugated sheet has a corrugated upper surface having peaks and valleys alternating with each other in the longitudinal direction across the entire foot width. In addition, at least one of the medial side or the lateral side of the corrugated sheet has a double structure, where the corrugated sheet is comprised of upper and lower sheets apart from each other in the thickness direction of the corrugated sheet with a predetermined gap interposed therebetween.

SUMMARY

According to the sole structure of Japanese Patent Publication No. 2000-4905, the rigidity against compression (i.e., the hardness against compression) of the double structure of the corrugated sheet ensures the stability of the foot (in particular a heel) of the person who wears the shoes having said sole structure (hereinafter referred to as a "wearer"). However, the corrugated sheet of this sole structure has the corrugations of relatively large amplitude uniformly across the entire foot width to increase the rigidity against compression. Therefore, when, for example, vertical impact occurs in the sole structure at the time of contact on the ground during walking or running, peaks of the upper surface of the corrugated sheet may give the feeling that the peaks are sticking into the plantar surface of the foot. That is, reaction force caused by the impact acts locally on the plantar surface via the peaks. As a result of pursuing the stability, the sole structure of Japanese Patent Publication No. 2000-4905 creates slightly uncomfortable feeling in the plantar surface of the wearer's foot, and fails to keep the wearer's foot appropriately comfortable.

In view of the foregoing background, an object of the present disclosure is to improve the comfort of the wearer's foot while maintaining the stability of a sole structure for shoes.

A first aspect of the present disclosure is directed to a sole structure for shoes. The sole structure includes: a sole body made of an elastic material; and a support positioned in a middle portion, in a thickness direction, of the sole body and made of a thin layer harder than the sole body. The support includes a base disposed in a middle region in a foot width direction and having an upper surface which follows a plantar surface of a wearer's foot, and an upper support and a lower support which are continuous with a side portion on at least one side, in the foot width direction, of the base. The upper support has an upper surface that is continuous with the side portion of the base such that the upper surface of the upper support, together with the upper surface of the base, follows the plantar surface. The lower support is continuous with the side portion of the base so as to be located under the upper support, and has a corrugated shape having peaks and valleys alternating with each other in a longitudinal direction along the side portion of the base.

According to the first aspect, the upper support has an upper surface that is continuous with the side portion of the base such that the upper surface of the upper support, together with the upper surface of the base, follows the plantar surface. That is, the support supports the plantar surface of the foot along the shape of the plantar surface by the upper surfaces of the base and the upper support via the sole body. Thus, even when, for example, vertical impact occurs in the sole structure at the time of contact on the ground during walking or running, reaction force caused by such impact is dispersed into the plantar surface of the foot in the areas corresponding to the base and the upper support. The sole structure contributes to reducing force that is locally applied to the plantar surface, and can therefore reduce uncomfortable feeling in the plantar surface and improve the comfort of the foot. On the other hand, the lower support is continuous with the side portion of the base so as to be located under the upper support, and has a corrugated shape having peaks and valleys alternating with each other in the longitudinal direction along the side portion of the base. The corrugated shape improves the rigidity of the lower support. Thus, even when, for example, vertical impact occurs in the sole structure, deformation of the sole structure at a position corresponding to the lower support is reduced. The sole structure can therefore prevent the foot of the wearer from leaning excessively toward the lateral sides in the foot width direction during walking or running, and stabilize the foot of the wearer. Consequently, the sole structure according to the first aspect can improve the comfort of the foot while maintaining the stability.

The second aspect of the present disclosure is an embodiment of the first aspect. In the second aspect, the upper surface of the base is a plain surface.

According to the second aspect, since the upper surface of the base is formed of a plain surface, the impact which occurs in the middle region in the foot width direction at the time of contact on the ground during walking or running is dispersed in the whole base, and local deformation of the base is less likely to occur. That is, the base as a whole is flexible and easily deformed, so that the base can absorb the impact which occurs in the middle region in the foot width direction.

The third aspect of the present disclosure is an embodiment of the first aspect. In the third aspect, the lower support includes a peak curve portion forming an upwardly projecting curve and having a peak integrally and continuously formed with the upper support, and a valley curve portion forming a downwardly projecting curve continuous with anterior and posterior portions of the peak curve portion.

According to the third aspect, the wearer's foot can be reliably stabilized because the peak curve portions and the valley curve portions increase the rigidity of the lower support, and because the peak, of each peak curve portion, which is integrally and continuously formed with the upper support makes the upper support firmly supported by the lower support.

The fourth aspect of the present disclosure is an embodiment of the first aspect. In the fourth aspect, a ribbed portion is provided between a lower surface of the upper support and an upper surface of the lower support.

According to the fourth aspect, the ribbed portion keeps the distance between the upper and lower supports, allowing the corrugated shape of the lower support to be maintained without being deformed due to degradation with time. Consequently, the sole structure can be stable for a long period of time.

The fifth aspect of the present disclosure is an embodiment of the first aspect. In the fifth aspect, the upper support has a side wall portion which rises from a side portion of the upper support and extends in the longitudinal direction.

According to the fifth aspect, the side wall portion can increase the flexural rigidity of the side portion of the upper support. This structure prevents the wearer's foot from excessively leaning toward the lateral sides in the foot width direction, and further stabilizes the foot.

The sixth aspect of the present disclosure is an embodiment of the first aspect. In the sixth aspect, the support is disposed at a region including a region corresponding to a heel portion of the wearer's foot.

According to the sixth aspect, the support is disposed at a region including a region corresponding to a heel portion of the wearer's foot. Thus, the support can appropriately absorb the impact which occurs in the heel portion when the foot of the wearer touches the ground during walking or running.

The seventh aspect of the present disclosure is an embodiment of the first aspect. In the seventh aspect, the upper and lower supports are disposed on a medial side in the foot width direction.

According to the seventh aspect, the rigidity of the support on the medial side is increased, which can thus increase the stability of the wearer's foot on the medial side when the wearer's foot touches the ground during walking or running.

The eighth aspect of the present disclosure is an embodiment of the first aspect. In the eighth aspect, the upper and lower supports are disposed on a lateral side in the foot width direction.

Such a structure according to the eighth aspect increases the rigidity of the lateral side of the support. Consequently, the wearer can make a smooth body weight shift in movements such as a side-step move, in which the lateral side of the foot is used as a starting point of the move, in sports such as baseball, soccer, volleyball, and basketball.

Ninth to sixteenth aspects of the present disclosure are directed to shoes comprising the sole structure of the first to eighth aspects, respectively.

According to the ninth to sixteenth aspects, shoes may be provided which are as advantageous as the first to eighth aspects.

As can be seen from the foregoing description, the present disclosure can improve the comfort of the foot while maintaining the stability.

DETAILED DESCRIPTION

An embodiment of the present disclosure will now be described in detail with reference to the drawings. Note that the following description of the embodiment is merely an example in nature, and is not intended to limit the scope, application, or uses of the present disclosure.

Figure 1:
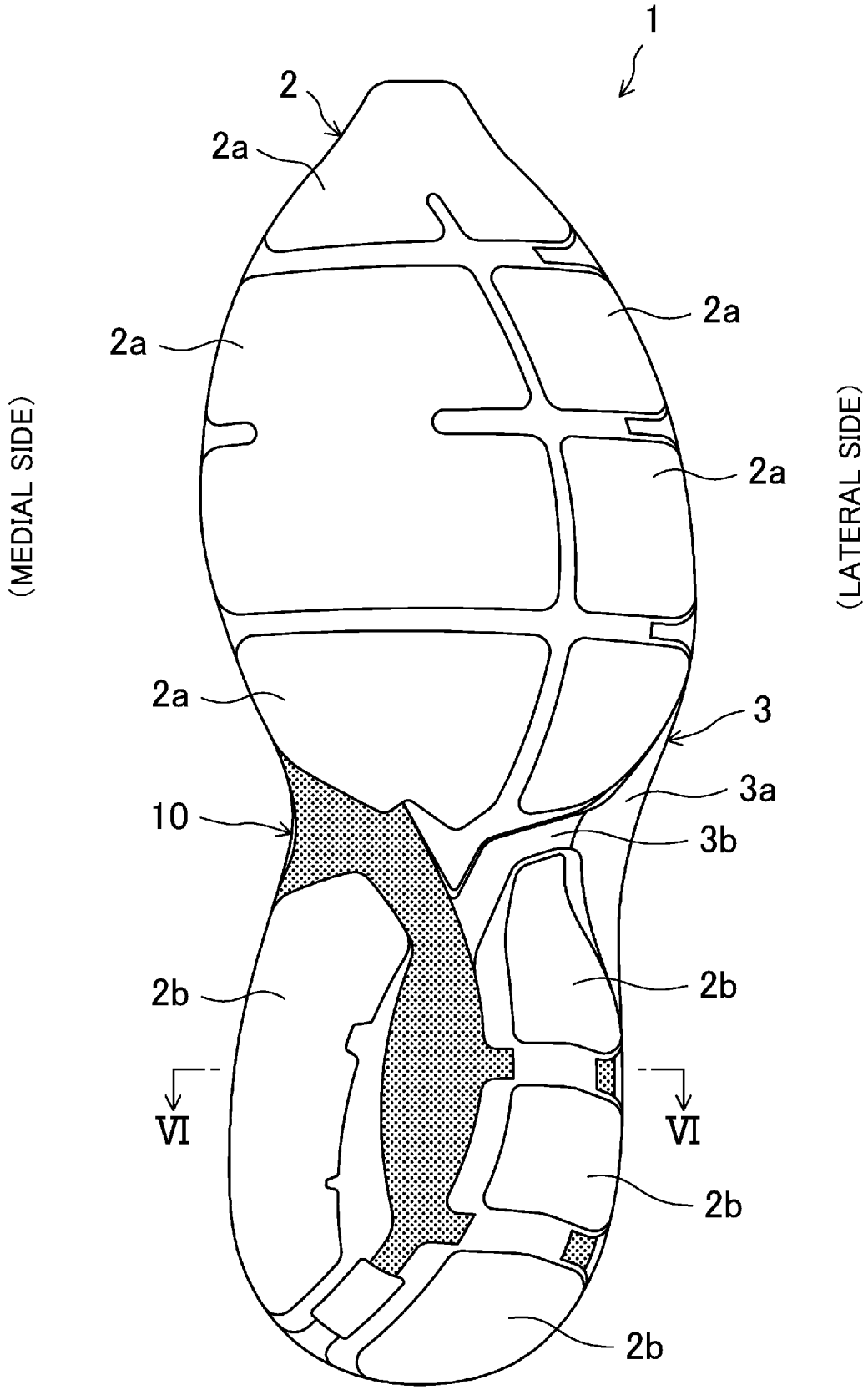
FIG. 1 is a bottom view of a sole structure for shoes according to a first embodiment of the present disclosure.
Figure 2:
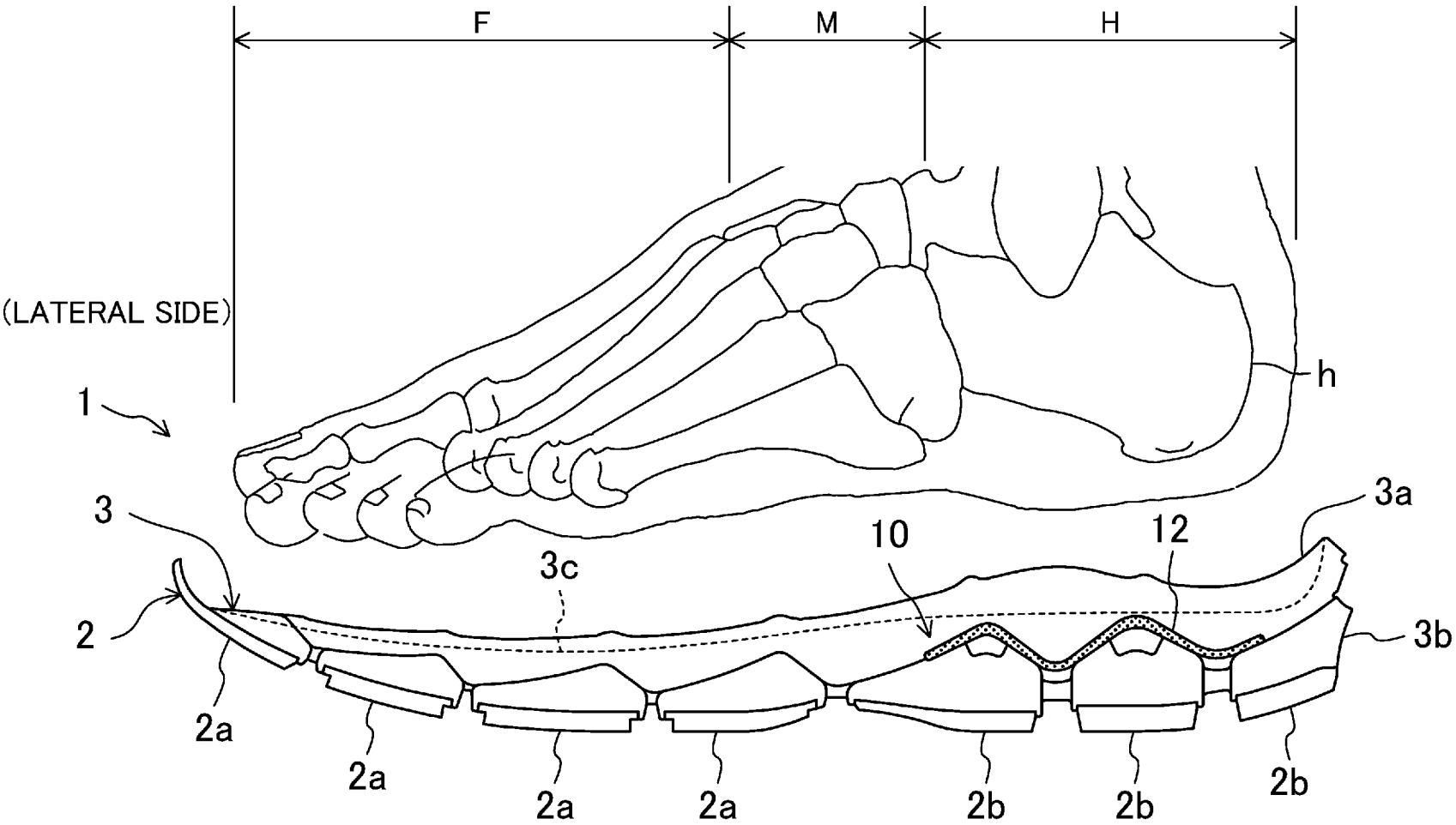
FIG. 2 is a side view of the sole structure with a human foot structure layered thereon, as viewed from a lateral side.
Figure 3:
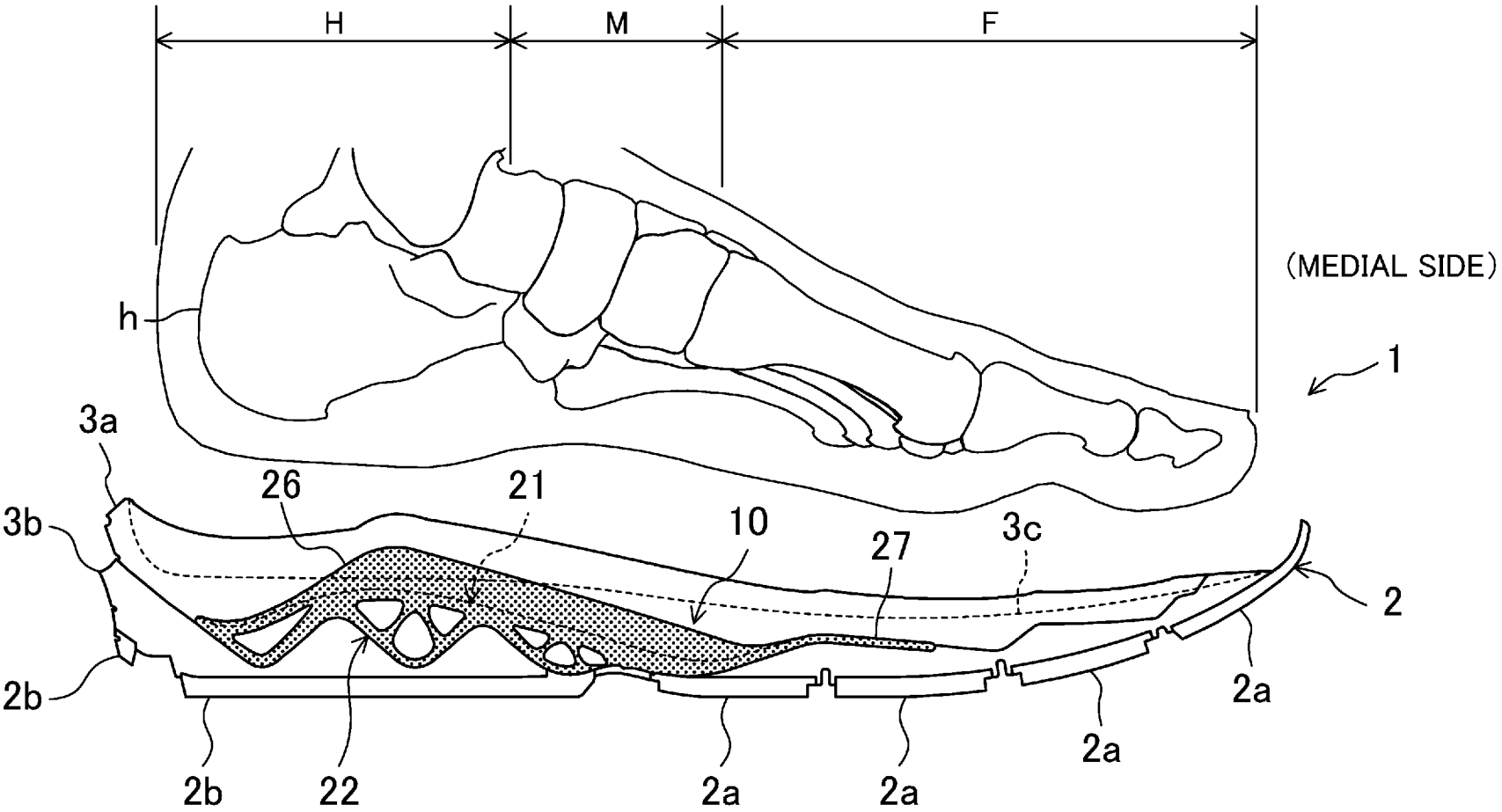
FIG. 3 is a side view of the sole structure with a human foot structure layered thereon, as viewed from a medial side.

FIGS. 1 to 3 show a whole sole structure 1 for shoes according to an embodiment of the present disclosure. A pair of shoes including this sole structure 1 and a shoe upper (not shown) provided on the sole structure 1 may be used, for example, as athletic shoes for running and various sports, sneakers for daily use, and rehabilitation shoes.

The drawings show the sole structure 1 for a left shoe only. A sole structure 1 for a right shoe is symmetrical to the sole structure 1 for the left shoe. In the following description, only the sole structure 1 for the left shoe will be described and the description of the sole structure 1 for the right shoe will be omitted.

In the following description, the expressions "above," "upward," "on a/the top of," "below," "under," and "downward," represent the vertical positional relationship between respective components of the sole structure 1. The expressions "front," "fore," "forward, "back," "hind," "behind," "backward" represent the positional relationship in the longitudinal direction (i.e., the longitudinal direction) between respective components of the sole structure 1. The expressions "medial side" and "lateral side" represent the positional relationship in the foot width direction (i.e., the foot width direction) between respective components of the sole structure 1.

(Outsole)

As illustrated in FIGS. 1 to 3, the sole structure 1 includes an outsole 2 provided to correspond to a region ranging from a forefoot F to a hindfoot H of a human body. The outsole 2 is made from a hard elastic material which is harder than the material for a midsole 3, which will be described later. Examples of suitable materials for the outsole 2 include, but are not limited to, thermoplastic resins such as ethylene-vinyl acetate copolymer (EVA), thermosetting resins such as polyurethane (PU), and rubber materials such as butadiene rubber and chloroprene rubber.

The outsole 2 is comprised of a plurality of fore outsoles 2*a*, 2*a*, . . . , which support a region from the forefoot F to an anterior portion of a midfoot M, and a plurality of hind outsoles 2*b*, 2*b*, . . . , which are separated from the fore outsoles 2*a*, 2*a*, . . . , and support a region from a posterior portion of the midfoot M to the hindfoot H. Each of the fore and hind outsoles 2*a*, 2*b* has, on its lower surface, a ground surface configured to touch the ground.

(Midsole)

As illustrated in FIGS. 1 to 3, the sole structure 1 includes a midsole 3 (a sole body) which supports the plantar surface of the foot from the forefoot F to the hindfoot H. The midsole 3 is made of a soft elastic material. Non-limiting suitable examples of the material for the midsole include thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials. The midsole 3 has a lower portion bonded to an upper portion of the outsole 2 (the fore and outsoles 2*a*, 2*b*) with an adhesive or other materials, and is thus stacked on the upper side of the outsole 2. A shoe upper (not shown) covering the foot of a person who wears the shoes having the sole structure 1 (hereinafter referred to as a "wearer") is attached to a peripheral portion of the midsole 3.

Figure 6:
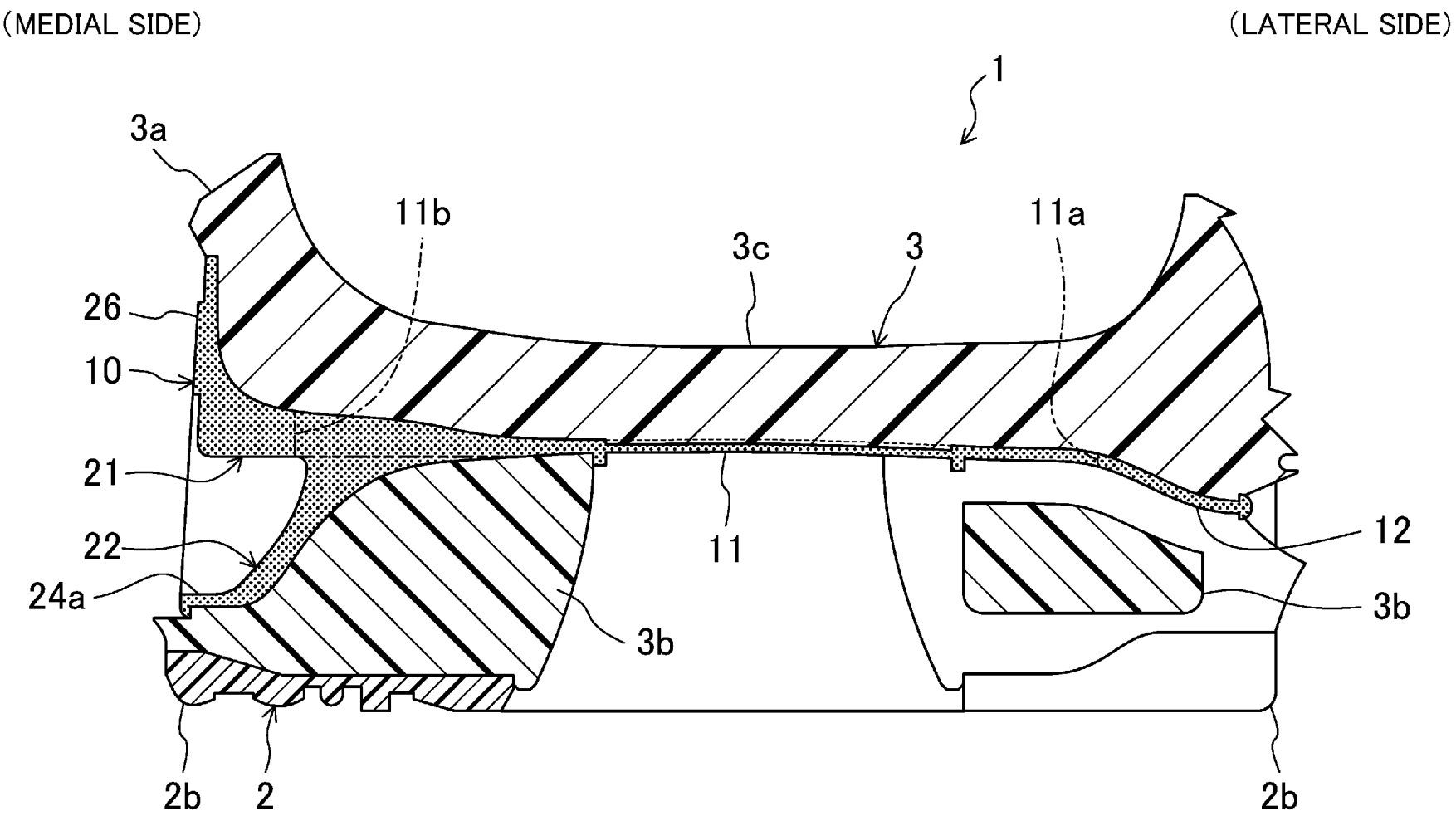
FIG. 6 is a cross-sectional view taken along the line VI-VI in FIG. 1.

The midsole 3 is divided in the vertical direction. Specifically, the midsole 3 has a multilayer structure including an upper midsole 3*a* and a lower midsole 3*b* stacked below the upper midsole 3*a*. The upper midsole 3*a* has, on its upper portion, a planta support surface 3*c* which extends in the longitudinal direction and supports a region of the plantar surface from the forefoot F to the hindfoot H. As illustrated in FIG. 6, the planta support surface 3*c* is curved downward toward the outsole 2, and shaped such that its peripheral portions corresponding to the medial side and the lateral side are located above its central portion in the foot width direction.

(Support)

As illustrated in FIGS. 1 to 3, the sole structure 1 includes a support 10 positioned in a middle portion, in the thickness direction, of the midsole 3 between the upper and lower midsoles 3*a*, 3*b*, and disposed at a region including the hindfoot H corresponding to a heel portion h of the foot (see FIGS. 2 and 3). The support 10 is comprised of a thin layer which is harder than the midsole 3, and is preferably made from a hard elastic material. Specific examples of such a hard elastic material include thermoplastic resins such as thermoplastic polyurethane (TPU), polyamide elastomer (PAE), and ABS, and thermosetting resins such as epoxy resins and unsaturated polyester resins. The support 10 may also be made from a fiber-reinforced plastic (FRP) containing carbon fibers, aramid fibers, or glass fibers as reinforcement fibers, and a thermosetting resin or a thermoplastic resin as a matrix resin.

The support 10 extends in the longitudinal direction from a posterior portion of the forefoot F and the hindfoot H of the foot, and is interlayered between the upper and lower midsoles 3*a* and 3*b*. As illustrated in FIG. 6, a dimension of the support 10 in the foot width direction is substantially equal to a dimension of the upper midsole 3*a* in the foot width direction. The lower and upper surfaces of the support 10 are respectively bonded to the upper surface of the lower midsole 3*b* and the lower surface of the upper midsole 3*a* with an adhesive, for example. In FIGS. 1 to 3 and 6, the support 10 is marked and accentuated with dot hatching.

Figure 4:
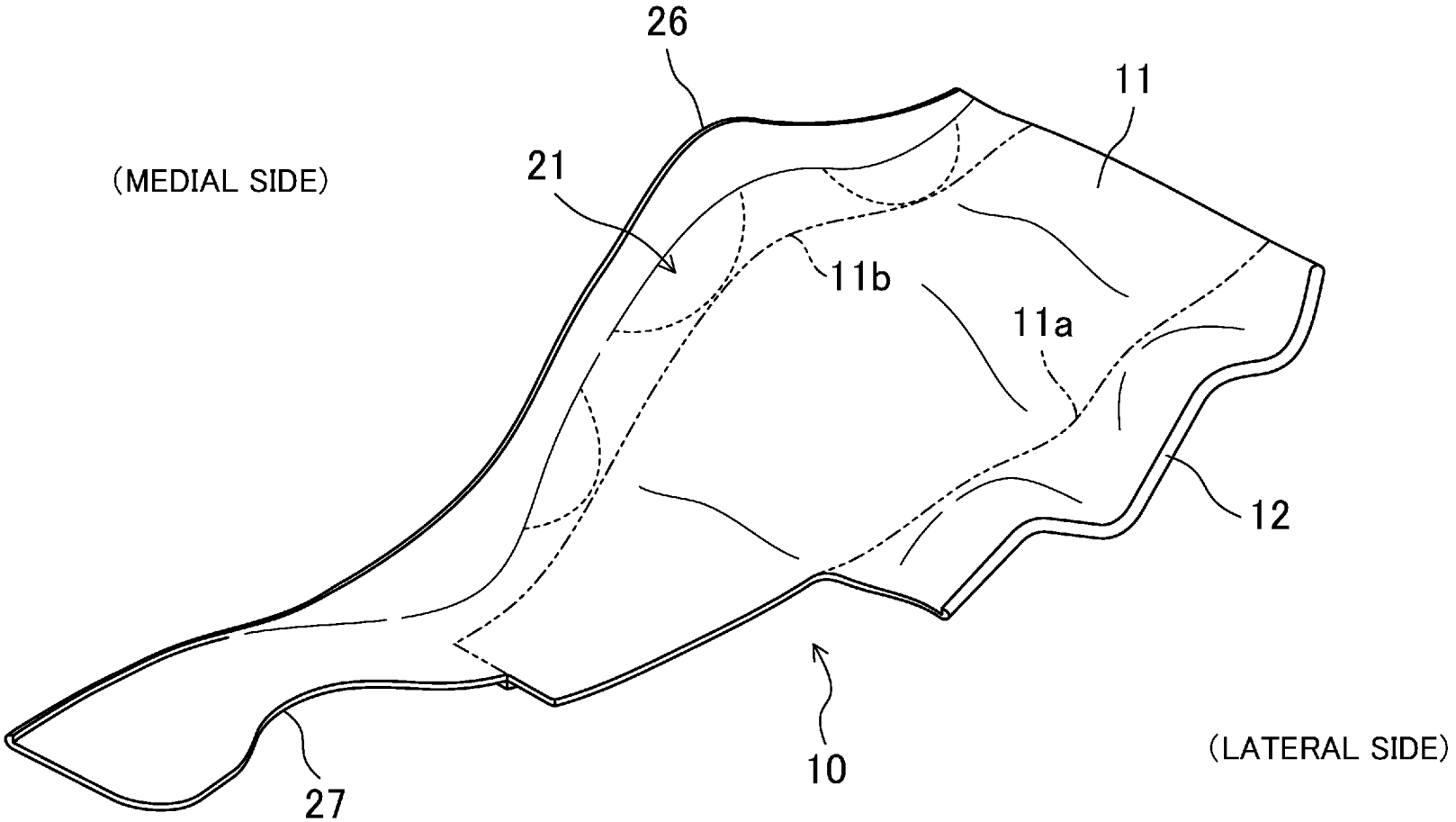
FIG. 4 is a perspective view of a support, as viewed from the lateral side.
Figure 5:
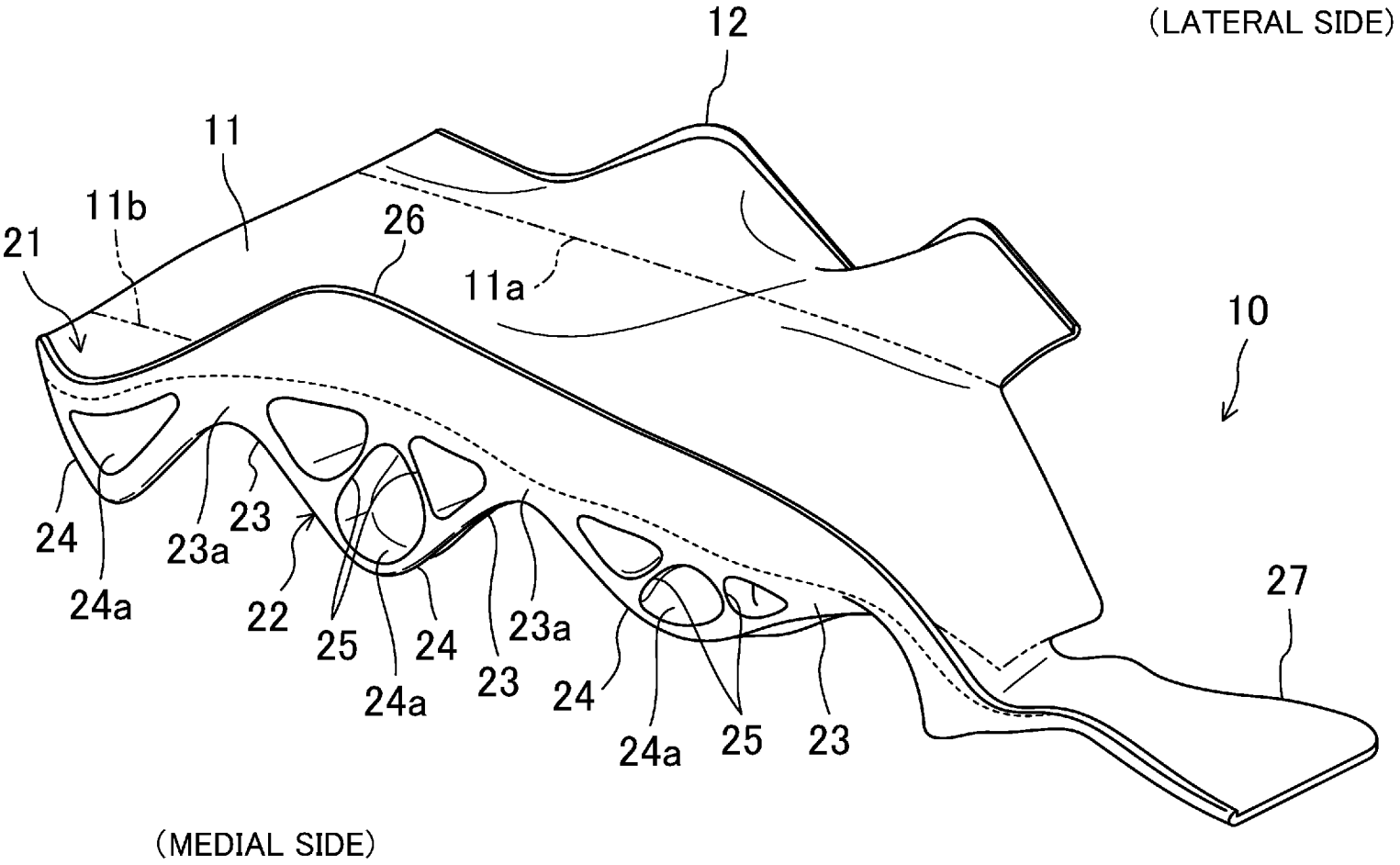
FIG. 5 is a perspective view of the support, as viewed from the medial side.

As illustrated in FIGS. 4 to 6, the support 10 has a base 11 in a middle region in the foot width direction between the medial side and the lateral side. The base 11 extends in the longitudinal direction from the midfoot M to the hindfoot H, and is configured to support the plantar surface corresponding to the middle region in the foot width direction. The base 11 has an upper surface following the shape of the plantar surface. Specifically, the upper surface of the base 11 is a plain surface. The "plain surface" used herein is not limited to a completely flat surface, but also includes a slightly-curved smooth surface.

As illustrated in FIG. 2, the support 10 has a corrugated side portion 12 provided at a position corresponding to the lateral side of the hindfoot H. As illustrated in FIGS. 4 and 5, the corrugated side portion 12 is continuous with a side portion 11*a* of the base 11 on the lateral side in the foot width direction, and has a corrugated shape having peaks and valleys alternating with each other in the longitudinal direction along the side portion 11*a* of the base 11. The corrugated side portion 12 having such a configuration increases the rigidity against compression on the lateral side of the support 10.

Now, as a feature of the present invention, the support 10 has an upper support 21 and a lower support 22 provided at a position corresponding to the medial side and extending from the midfoot M to the hindfoot H, as illustrated in FIGS. 3 to 6.

As illustrated in FIGS. 4 and 6, the upper support 21 is continuous with a side portion 11*b* of the base 11 on the medial side. The upper support 21 has an upper surface which, together with the upper surface of the base 11, follows the shape of the plantar surface.

On the other hand, as illustrated in FIG. 6, the lower support 22 is continuous with the side portion 11*b* of the base 11 on the medial side so as to be located under the upper support 21. Specifically, the lower support 22 extends downward and toward the medial side from the side portion 11*b* of the base 11 so as to be located under the upper support 21. In other words, the lower support 22 is branched from the side portion 11*b* of the base 11 toward the medial side in a different direction than the upper support 21.

As illustrated in FIG. 3, the lower support 22 has a corrugated shape having peaks and valleys alternating with each other in the longitudinal direction along the side portion 11*b* of the base 11. Specifically, as illustrated in FIG. 5, the lower support 22 has peak curve portions 23, 23, . . . , and valley curve portions 24, 24, . . . . Each peak curve portion 23 forms an upwardly projecting curve. Each peak curve portion 23 includes a peak 23*a* integrally and continuously formed with the upper support 21. On the other hand, each valley curve portion 24 forms a downwardly projecting curve continuous with anterior and posterior portions of the peak curve portion 23. A lower portion of the valley curve portion 24 is provided with a bottom portion 24*a* located below the peak 23*a* of the peak curve portion 23.

Further, approximately plate-like ribbed portions 25, 25, . . . , are provided between a lower surface of the upper support 21 and an upper surface of the lower support 22. Each ribbed portion 25 has an upper portion continuous with the lower surface of the upper support 21, and a lower portion continuous with the upper surface of the lower support 22.

As illustrated in FIGS. 4 to 6, the upper support 21 includes approximately a plate-like side wall portion 26 which rises from a side portion of the medial side. The side wall portion 26 extends in the longitudinal direction from a posterior end to an anterior end of the upper support 21.

As illustrated in FIGS. 4 to 5, the upper support 21 includes a reinforcement portion 27 which extends toward the front from the anterior end of the upper support 21. The reinforcement portion 27 is interlayered between the upper and lower midsoles 3*a* and 3*b* at a position corresponding to the medial side of a posterior portion of the forefoot F. The reinforcement portion 27 improves the rigidity of the sole structure 1 at the position corresponding to the medial side of the posterior portion of the forefoot F.

Advantages of Embodiment

As explained above, according to the sole structure 1, the upper support 21 is continuous with the side portion 11*b* of the base 11 such that the upper surface of the upper support 21, together with the upper surface of the base 11, follows the shape of the plantar surface. That is, the support 10 supports the plantar surface of the foot along the shape of the plantar surface by the upper surfaces of the base 11 and the upper support 21 via the midsole 3*a*. Thus, even when, for example, vertical impact occurs in the sole structure 1 at the time of contact on the ground during walking or running, reaction force caused by such impact is dispersed into the plantar surface of the foot in the regions corresponding to the base 11 and the upper support 21. The sole structure 1 contributes to reducing force that is locally applied to the plantar surface, and can therefore reduce uncomfortable feeling in the plantar surface and improve the comfort of the foot. On the other hand, the lower support 22 is continuous with the side portion 11*b* of the base 11 so as to be located under the upper support 21, and has a corrugated shape having peaks and valleys alternating with each other in the longitudinal direction along the side portion 11*b* of the base 11. The corrugated shape improves the rigidity (in particular, the rigidity against compression) of the lower support 22. Thus, even when, for example, vertical impact occurs in the sole structure 1, deformation of the sole structure 1 at a position corresponding to the lower support 22 is reduced. The sole structure 1 can therefore prevent the foot (particular the ankle) of the wearer from leaning excessively toward the medial side in the foot width direction during walking or running, and stabilize the foot of the wearer. Consequently, the sole structure 1 according to an embodiment of the present invention can improve the comfort of the foot while maintaining the stability.

Moreover, since the upper surface of the base 11 is formed of a plain surface, the impact which occurs in the middle region in the foot width direction at the time of contact on the ground during walking or running is dispersed in the whole base 11, and local deformation of the base 11 is less likely to occur. That is, the base 11 as a whole is flexible and easily deformed, so that the base 11 can absorb the impact which occurs in the middle region in the foot width direction.

Further, the wearer's foot can be reliably stabilized because the peak curve portions 23, 23, . . . , and the valley curve portions 24, 24, . . . , increase the rigidity of the lower support 22, and because the peak 23*a*, of each peak curve portion 23, which is integrally and continuously formed with the upper support 21 makes the upper support 21 firmly supported by the lower support 22.

Further, the ribbed portions 25 provided between the upper surface of the lower support 22 and the lower surface of the upper support 21 keeps the distance between the upper and lower supports 21 and 22, allowing the corrugated shape of the lower support 22 to be maintained without being deformed due to degradation with time. Consequently, the sole structure 1 can be stable for a long period of time.

The side wall portion 26 provided on a side portion of the upper support 21 can increase the flexural rigidity of the side portion of the upper support 21. This structure prevents the wearer's foot from excessively leaning toward the lateral sides in the foot width direction, and further stabilizes the foot.

The support 10 is disposed at a region including a region corresponding to a heel portion of the wearer's foot. Thus, the support 10 can appropriately absorb the impact which occurs in the heel portion when the foot of the wearer touches the ground during walking or running.

Further, the upper and lower supports 21 and 22 disposed on the medial side in the foot width direction increases the rigidity of the support 10 on the medial side, which can increase the stability of the wearer's foot on the medial side when the wearer's foot touches the ground during walking or running.

Other Embodiments

The sole structure 1 of the embodiment described above includes the base 11 having a plain upper surface. However, this is merely a non-limiting example. The upper surface of the base 11 may be a curved surface which follows the uneven shapes of the plantar surface of the wearer's foot. For example, the upper surface of the base 11 may be curved with peaks and valleys alternating with each other in the longitudinal direction at a respective curvature smaller than the curvatures of the peak curve portion 23 and the valley curve portion 24. That is, the upper surface of the base 11 may be corrugated with gentle curves, compared with the corrugated shape of the lower support 21. In short, the upper surface of the base 11 may be in any shape unless the shape stimulates the wearer's plantar surface too much. The same holds true for the upper surface of the upper support 21.

The sole structure 1 of the embodiment described above includes both of the outsole 2 and the midsole 3. However, this is merely a non-limiting example. The sole structure 1 may be configured without the outsole 2. In short, the midsole 3 at least includes the midsole 3, which is a sole body.

The sole structure 1 of the embodiment described above includes the support 10 disposed at a region including the hindfoot H corresponding to the heel portion h of the foot. However, this is merely a non-limiting example. For example, the support 10 may be disposed to correspond to the forefoot F and/or the midfoot M.

The sole structure 1 of the embodiment described above includes the upper and lower supports 21, 22 disposed on the medial side in the foot width direction. However, this is merely a non-limiting example. For example, the upper and lower supports 21, 22 may be disposed on the lateral side in the foot width direction. Such a structure increases the rigidity of the lateral side of the support 10. Consequently, the wearer can make a smooth body weight shift in movements such as a side-step move, in which the lateral side of the foot is used as a starting point of the move, in sports such as baseball, soccer, volleyball, and basketball. Alternatively, the upper and lower supports 21, 22 may be disposed on both of the medial and lateral sides in the foot width direction.

The sole structure 1 of the embodiment described above includes the lower support 22 in which the peaks 23*a* of the peak curve portions 23 are integrally and continuously formed with the upper support 21. However, this is merely a non-limiting example. There may be a certain gap between the peak 23*a* of each peak curve portion 23 and the upper support 21.

The sole structure 1 of the embodiment described above includes the ribbed portions 25, 25, . . . . However, the ribbed portions 25, 25, . . . , may be omitted. The side wall portion 26 and the reinforcement portion 27 may also be omitted.

Note that the present disclosure is not limited to the embodiment described above, and various changes and modifications may be made without departing from the scope of the present disclosure.

The present disclosure is industrially applicable to, for example, a sole structure for athletic shoes for walking, running, and various sports, sneakers for daily use, or rehabilitation shoes and to shoes including the sole structure.

What is claimed is:

1. A sole structure for shoes, the sole structure comprising:

a sole body made of an elastic material; and a support positioned in a middle portion, in a thickness direction, of the sole body and made of a thin layer harder than the sole body, wherein the support includes a base disposed in a middle region in a foot width direction and having an upper surface configured to be along a plantar surface of a foot of a wearer wearing the shoe, and an upper support and a lower support which are continuous with a side portion on at least one side, in the foot width direction, of the base, the upper support has an upper surface that is continuous with the side portion of the base such that the upper surface of the upper support, together with the upper surface of the base, follows the plantar surface, the lower support is continuous with the side portion of the base so as to be located under the upper support, and has a corrugated shape having peaks and valleys alternating with each other in a longitudinal direction along the side portion of the base, the lower support includes a peak curve portion forming an upwardly projecting curve and having a peak integrally and continuously formed with the upper support, and a valley curve portion forming a downwardly projecting curve continuous with anterior and posterior portions of the peak curve portion, and the valley curve portion has, in a cross section along the foot width direction, one end portion in the foot width direction which is integrally formed with the side portion of the base, and the other end portion in the foot width direction which is branched from the side portion of the base in a downward direction with respect to the upper support.

2. The sole structure of claim 1, wherein the upper surface of the base is a plain surface.

3. The sole structure of claim 1, wherein a ribbed portion is provided between the lower surface of the upper support and the upper surface of the lower support.

4. The sole structure of claim 1, wherein the upper support has a side wall portion which rises from a side portion of the upper support and extends in the longitudinal direction.

5. The sole structure of claim 1, wherein the support is disposed at a region including a region corresponding to a heel portion of the wearer's foot.

6. The sole structure of claim 1, wherein the upper and lower supports are disposed on a medial side in the foot width direction.

7. The sole structure of claim 1, wherein the upper and lower supports are disposed on a lateral side in the foot width direction.

8. A shoe comprising a sole structure for shoes, the sole structure comprising:

a sole body made of an elastic material; and support positioned in a middle portion, in a thickness direction, of the sole body and made of a thin layer harder than the sole body, wherein the support includes a base disposed in a middle region in a foot width direction and having an upper surface configured to be along a plantar surface of a foot of a wearer wearing the shoe, and an upper support and a lower support which are continuous with a side portion on at least one side, in the foot width direction, of the base, the upper support has an upper surface that is continuous with the side portion of the base such that the upper surface of the upper support, together with the upper surface of the base, follows the plantar surface, the lower support is continuous with the side portion of the base so as to be located under the upper support, and has a corrugated shape having peaks and valleys alternating with each other in a longitudinal direction along the side portion of the base, the lower support includes a peak curve portion forming an upwardly projecting curve and having a peak integrally and continuously formed with the upper support, and a valley curve portion forming a downwardly projecting curve continuous with anterior and posterior portions of the peak curve portion, and the valley curve portion has, in a cross section along the foot width direction, one end portion in the foot width direction which is integrally formed with the side portion of the base, and the other end portion in the foot width direction which is branched from the side portion of the base in a downward direction with respect to the upper support.

9. The shoe of claim 8, wherein the upper surface of the base is a plain surface.

10. The shoe of claim 8, wherein a ribbed portion is provided between the lower surface of the upper support and the upper surface of the lower support.

11. The shoe of claim 8, wherein the upper support has a side wall portion which rises from a side portion of the upper support and extends in the longitudinal direction.

12. The shoe of claim 8, wherein the support is disposed at a region including a region corresponding to a heel portion of the wearer's foot.

13. A shoe of claim 8, wherein the upper and lower supports are disposed on a medial side in the foot width direction.

14. The shoe of claim 8, wherein the upper and lower supports are disposed on a lateral side in the foot width direction.

* * * * *